US006524397B2

(12) United States Patent
Sakurai et al.

(10) Patent No.: US 6,524,397 B2
(45) Date of Patent: Feb. 25, 2003

(54) METHOD FOR REMOVING AN ACIDIC DEPOSIT

(75) Inventors: Shigeru Sakurai, Fukuoka (JP); Masaharu Emoto, Fukuoka (JP); Hachiro Hirano, Chiba (JP); Makoto Yoshida, Tokyo (JP); Hiroaki Noda, Chiba (JP); Michihiro Kawano, Fukuoka (JP)

(73) Assignee: Asahi Glass Company, Limited, Tokyo (JP)

( * ) Notice: Subject to any disclaimer, the term of this patent is extended or adjusted under 35 U.S.C. 154(b) by 0 days.

(21) Appl. No.: 09/825,829

(22) Filed: Apr. 5, 2001

(65) Prior Publication Data

US 2001/0039958 A1 Nov. 15, 2001

(30) Foreign Application Priority Data

Apr. 7, 2000 (JP) ..... 2000-106733

(51) Int. Cl.[7] ..... B08B 3/04

(52) U.S. Cl. ..... 134/29; 134/2; 134/22.1; 134/22.11; 134/22.12; 134/22.13; 134/22.14; 134/22.16; 134/22.17; 134/22.19; 134/26; 134/34; 134/36; 134/42

(58) Field of Search ..... 134/2, 22.1, 22.11, 134/22.12, 22.13, 22.14, 22.16, 22.17, 22.19, 26, 29, 34, 36, 42

(56) References Cited

U.S. PATENT DOCUMENTS

| | | | | | |
|---|---|---|---|---|---|
| 2,140,183 | A | * | 12/1938 | Bresler | 134/22.16 |
| 2,787,326 | A | * | 4/1957 | Hughes | 134/22.11 |
| 3,360,399 | A | * | 12/1967 | Knox et al. | 134/27 |
| 3,660,287 | A | * | 5/1972 | Quattrini | 166/305.1 |
| 5,146,988 | A | * | 9/1992 | Paul | 134/3 |
| 5,575,857 | A | * | 11/1996 | Lunski et al. | 134/2 |

* cited by examiner

*Primary Examiner*—Sharidan Carrillo
(74) *Attorney, Agent, or Firm*—Oblon, Spivak, McClelland, Maier & Neustadt, P.C.

(57) ABSTRACT

A method for removing an acidic deposit containing a sulfur compound, which comprises contacting the acidic deposit with an aqueous solution of an alkali metal carbonate and/or an alkali metal hydrogencarbonate to remove it.

9 Claims, 1 Drawing Sheet

METHOD FOR REMOVING AN ACIDIC DEPOSIT

The present invention relates to a method for removing an acidic deposit attached to an apparatus for a combustion process, such as a boiler, etc.

When a fuel containing a sulfur component is burned by a combustion process such as a boiler, an acidic deposit containing a sulfur compound will usually form at a portion of a piping or an apparatus disposed between a combustion furnace and a chimney, where a high temperature exhaust gas (hereinafter referred to as the exhaust gas) formed during the combustion, will contact. Especially in a boiler, an apparatus (hereinafter referred to as an heat exchanger) for heat exchange between the exhaust gas and a low temperature air for combustion, is installed in order to improve the combustion efficiency and to prevent corrosion, whereby such an acidic deposit is likely to form.

Usually, in the operation of a boiler, the temperature of the exhaust gas is higher than the dew point of sulfuric acid, and a sulfur compound such as $SO_3$ (hereinafter referred to as a $SO_3$ component) contained in the exhaust gas will not condense as sulfuric acid in a piping or an apparatus (hereinafter referred to simply as in an apparatus) disposed between the combustion furnace and the chimney. However, once the operation of the boiler is stopped, the interior of the apparatus becomes lower than the dew point of sulfuric acid, and the $SO_3$ component in the exhaust gas will condense and attach as sulfuric acid in the apparatus. And, this sulfuric acid will react with at least one component selected from the group consisting of ammonium, sodium, potassium, magnesium, calcium and vanadium, contained in the fuel oil or added during combustion, to form an acidic solid salt such as a hydrogensulfate represented, for example, by ammonium hydrogensulfate, and this hydrogensulfate will be mixed with a dust and will attach in the apparatus. This substance attached in the apparatus is referred to as an acidic deposit. The acidic substance further includes other acidic substances such as hydrochloric acid, nitric acid and sulfuric acid which may be formed depending upon the fuel, the combustion method and the combustion conditions, and further, the acidic deposit may contain iron rust, dust and soot which are insoluble in water.

If such an acidic deposit remains in the apparatus for a combustion process, such as a boiler, there will be problem that as the combustion operation continues, it will hinder the flow of gas, and it will bring about corrosion of a metal such as iron in the apparatus. Accordingly, it is necessary to periodically remove such an acidic deposit.

Heretofore, in the case of a heat exchanger in a combustion process such as a boiler, it has been common to carry out removal of an acidic deposit by a method of washing with water, heat storage elements (hereinafter referred to simply as elements) constituting the regenerative heat exchanger after or without dismounting them.

However, if this acidic deposit is washed with water, the sulfuric acid component in the acidic deposit will dissolve in water to form an acidic aqueous solution. Especially in the case of a heat exchanger, the shapes of the elements are complex, and there will be a problem such that even if a large amount of water is used for washing, dilute sulfuric acid is likely to remain at corners of the elements. Thus, due to sulfuric acid which will form at the time of washing the acidic deposit with water, corrosion is likely to result at the heat exchanger elements or at metallic portions to be used for instruments disposed in a flue, such as a valve or a dust removing equipment, thus leading to a serious problem with respect to the useful life of the installation or stable continuous operation.

Under these circumstances, it is an object of the present invention to provide a method whereby the acidic deposit in a combustion apparatus such as a boiler can be removed easily, safely and in a short time, and the amount of waste water can be reduced.

The present invention provides a method for removing an acidic deposit containing a sulfur compound, which comprises contacting the acidic deposit with an aqueous solution of an alkali metal carbonate and/or an alkali metal hydrogencarbonate to remove it.

Figure 1:
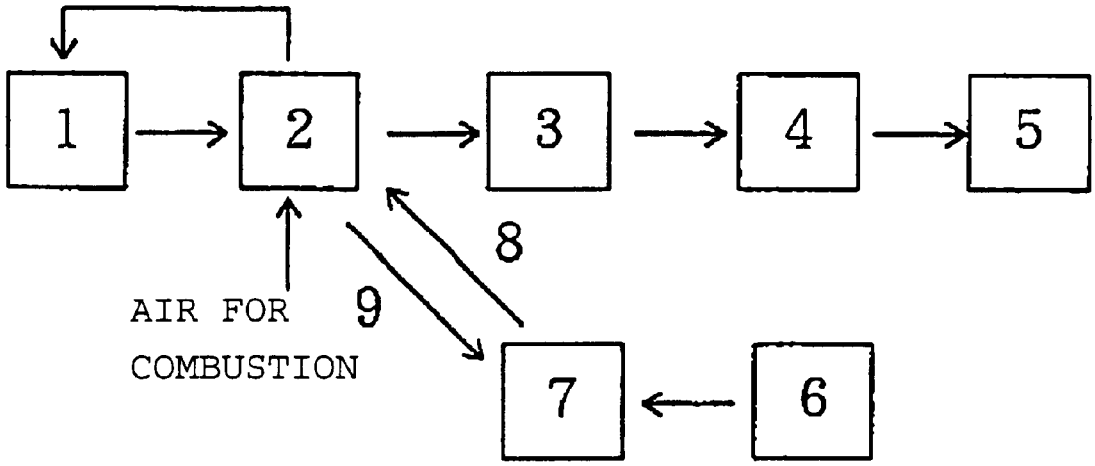
FIG. 1 shows a diagram illustrating an embodiment of an apparatus.

In the diagram an exhaust gas is formed by combustion of a heavy oil, wherein reference numeral 1 indicates a boiler, 2 an air heater (an air preheater), 3 a dust collector, 4 a desulfurization equipment, 5 a stack, 6 a mixing vessel, 7 a waster water pit, 8 a cleaning piping (going) and 9 a cleaning piping (returning).

Now, the present invention will be described in detail with reference to the preferred embodiments.

The present invention is applicable to removal of an acidic deposit attached to e.g. a piping, or gas duct, or an apparatus or its constituting elements, disposed between a combustion furnace of a boiler or the like and a stack. Especially for a heat exchanger, the effects of the present invention are remarkable as compared with a conventional removal method, since its shape is complex, and an enamel coating (a porcelain enameling or vitreous enameling) is applied in many cases. Among various heat exchangers, a regenerative rotary heat exchanger is particularly suitable from the viewpoint of the shape and material. As such a regenerative rotary heat exchanger, a Ljungstrom air preheater (manufactured by ALSTOM Power K.K.) or a rotary heat exchanger (manufactured by Kanken Techno Co. Ltd.) may, for example, be mentioned.

In the present invention, the alkali metal carbonate and/or the alkali metal hydrogencarbonate may, for example, be sodium carbonate, potassium carbonate, sodium hydrogencarbonate or potassium hydrogencarbonate. Among them, sodium hydrogencarbonate is particularly preferred, since, when it is dissolved in water, the pH is low and weakly alkaline, whereby the hydrogen ion concentration will not exceed the regulated value stipulated in a law which regulates water pollution, and it can be handled safely by an operator. When it is desired to avoid inclusion of sodium or to increase the concentration of the aqueous solution, it is preferred to employ potassium hydrogencarbonate. In this specification, the alkali metal carbonate and/or the alkali metal hydrogencarbonate will generally be referred to as an alkali metal carbonate.

An alkali metal carbonate will react with the acidic deposit to generate carbon dioxide gas and thereby undergo foaming, and accordingly, it dissolves the acidic deposit while peeling it by the foaming mechanical action. At the same time, it peels and removes also iron rust, dust and soot in the acidic deposit. By the foaming by carbon dioxide, the cleaning effect can be improved, and the cleaning time can be shortened. Even when the object to be cleaned is one having a complicated shape and difficult to clean, cleaning can be carried out in a short period of time.

As compared with sodium carbonate, sodium hydrogencarbonate has a large content of carbon dioxide per unit mass of the substance. Accordingly, for the cleaning by utilizing foaming, sodium hydrogencarbonate is preferred to sodium carbonate. However, in a case where the pH during cleaning is to be adjusted to a level of at least 9, it is preferred to use sodium carbonate.

In the present invention, when sodium hydrogencarbonate is used as an alkali metal carbonate, the concentration of the aqueous solution is preferably from 3 to 16 mass %. If the concentration of the aqueous sodium hydrogencarbonate solution is less than 3 mass %, the amount of cleaning water to be used will increase, such being undesirable. On the other hand, if the concentration exceeds 16 mass %, the temperature of the aqueous solution is required to be high, such being undesirable from the viewpoint of simple, safe operation. The concentration of the aqueous sodium hydrogencarbonate solution is particularly preferably from 5 to 14 mass %.

In the present invention, the temperature of the aqueous solution of an alkali metal carbonate is preferably at most 80° C. When the temperature is at most 80° C., the operation can be carried out safely. The temperature of the aqueous solution of an alkali metal carbonate is particularly preferably at most 60° C.

In the present invention, it is preferred that the aqueous solution of an alkali metal carbonate contains a solid alkali metal carbonate, whereby it can be used for a larger amount of an acidic deposit, and the amount of waste water can be made small.

When the alkali metal carbonate is sodium hydrogencarbonate, the solid concentration of sodium hydrogencarbonate in the aqueous sodium hydrogencarbonate solution is preferably from 0.1 to 30 mass %. If the solid concentration is less than 0.1 mass %, no substantial difference in the effect will be obtained as compared with a case where no solid sodium hydrogencarbonate is contained. If the solid concentration exceeds 30 mass %, the viscosity of the slurry tends to increase, and solid sodium hydrogencarbonate is likely to remain in the object to be cleaned, whereby uniform cleaning can hardly be carried out. Particularly preferably, the solid concentration of the aqueous sodium hydrogencarbonate solution is from 2 to 25 mass %.

In the present invention, the aqueous solution of an alkali metal carbonate preferably has a sodium chloride content of at most 0.1 mass %. If the sodium chloride content exceeds 0.1 mass %, chlorine ions are likely to corrode stainless steel, etc., thus leading to stress corrosion cracking, such being undesirable. The content of sodium chloride is particularly preferably at most 0.05 mass %, further preferably at most 0.01 mass %.

In the present invention, the method of contacting the aqueous solution of an alkali metal carbonate with the acidic deposit, is preferably a method of dipping the object to be treated in the aqueous solution of an alkali metal carbonate, or a method of spraying such an aqueous solution. If the object to be treated is a detachable part, it is preferably detached and immersed in the aqueous solution. In a case where a flue or an air heater which is to be treated in such a state as attached to an apparatus, it is preferred to spray the aqueous solution by means of a spray or the like.

In the present invention, the pH of the aqueous solution of an alkali metal carbonate is preferably from 6.5 to 8.5. In a case where the object to be treated is immersed in the aqueous solution for treatment, the pH decreases as removal of the acidic deposit proceeds, and it is likely to be less than pH 6.5. Accordingly, it is preferred to add an aqueous solution and/or a powder of an alkali metal carbonate, as the case requires. If the pH is less than 6.5, the installation is likely to be corroded, and if the pH exceeds 8.5, the alkali metal carbonate or the alkali metal hydrogencarbonate is likely to remain unreacted in the cleaning water, whereby the reagent is cleaned, or when the element has an enamel coating, the enamel is likely to be corroded by the alkali, such being undesirable. The pH is particularly preferably from 6.9 to 8.4.

In the present invention, it is preferred that after removal of the acidic deposit, the reaction product, iron rust and dust attached to the object to be treated, will be removed by washing with water. The washing with water is carried out until the pH of water after washing will be from 6.0 to 8.0. If the pH of water after washing is less than 6.0, the possibility that the acidic deposit still remains, is high, and if the pH exceeds 8.0, it is likely that sodium hydrogencarbonate remains. The pH of the water after washing is particularly preferably from 6.5 to 7.5.

Now, the present invention will be described in further detail with reference to Examples. However, it should be understood that the present invention is by no means restricted by such specific Examples.

EXAMPLE 1

Example of the Present Invention

As a cleaning liquid, a 10% sodium hydrogencarbonate aqueous solution was prepared and filled in a container of about 20 l. In this container containing the cleaning liquid, an enamel-coated element (base material: a steel sheet for porcelain enameling) of a vertical regenerative rotary heat exchanger (manufactured by ALSTOM Power K.K.) was immersed. The pH of the cleaning liquid at that time was 8. Immediately upon dipping the above element in the cleaning liquid, foaming took place, and the acidic deposit started to peel. About 3 hours later, the acidic deposit peeled substantially completely. Further, the element was continuously immersed in the cleaning liquid overnight. Then, the element was withdrawn from the cleaning liquid and washed with industrial water until the pH of the washing water became 7.5.

As a result of the inspection after completion of the cleaning and washing operation, the acidic deposit attached to the element was completely removed, and no corrosion was observed on the element.

EXAMPLE 2

Comparative Example

The operation was carried out in the same manner as in Example 1 except that as the cleaning liquid, industrial water was used instead of the 10% sodium hydrogencarbonate aqueous solution. When the element was dipped in the industrial water in the container, the pH was 2. In the same manner as in Example 1, the element was immersed in industrial water overnight, and then the element was withdrawn from the washing liquid, and washing was carried out until the pH of the washing water became 7.5.

As a result of the inspection after completion of the washing operation, the acidic deposit attached to the element was not substantially removed, and corrosion was observed on the element.

EXAMPLE 3

Example of the Present Invention

An air heater installed on a combustion furnace of a power plant was cleaned with a 6% sodium hydrogencarbonate aqueous solution by means of a stationary cleaning installation. This air heater was operated for about 4 months using a heavy oil containing 6% of a sulfur content as a fuel.

The type of the air heater was a vertical regeneration rotary heat exchanger (manufactured by ALSTOM Power K.K.) like in Example 1, and with respect to the material of the element, the high temperature portion was made of mild steel (SS400), and the low temperature portion was made of one having enamel coating applied on a base material of a steel sheet for porcelain enameling (GPE, manufactured by NIPPON STEEL CORPORATION), and the total number of elements was about 200.

The acidic deposit attached to this air heater was sampled and the components were analyzed and found to be as shown in Table 1.

In the composition of Table 1, sodium (hereinafter referred to as Na), potassium (hereinafter referred to as K), calcium (hereinafter referred to as Ca) and vanadium (hereinafter referred to as V) were derived from the heavy oil, magnesium (hereinafter referred to as Mg) was derived mainly from an additive to the heavy oil, an ammonium ion (hereinafter referred to as $NH_4^+$) is a substance derived from an ammonia gas injected to the waste gas in order to remove the $SO_3$ component, and the water-insolubles were iron rust or dust such as unburned carbon.

TABLE 1

| Components | Content | Analytical method |
|---|---|---|
| Na | 4.6% | Flame analysis |
| K | 0.1% | Flame analysis |
| Ca | 0.6% | Atomic absorption spectrometry |
| Mg | 14% | Atomic absorption spectrometry |
| V | 2.9% | ICP emission spectrometry |
| $NH_4^+$ | 3.8% | Distillation method |
| $SO_4^{2-}$ | 19% | Ion chromatography |
| pH (0.1% solution) | 2.58 | pH meter |
| Water-insolubles | 41% | Gravimetric analysis |

The construction of the installation used in Example 1 is shown in FIG. 1. The air heater is a heat exchanger 2 to increase the temperature of the air for combustion by carrying out heat exchange between a high temperature exhaust gas discharged from a boiler 1 and a low temperature air for combustion.

Using a mixing vessel 6, a 6% sodium hydrogencarbonate aqueous solution was prepared and sent to a waste water pit 7, and the 6% sodium hydrogencarbonate aqueous solution was sent via a cleaning piping 8 into an air heater 2 and sprayed. The cleaning liquid was returned via a cleaning piping 9 to the waste water pit 7. The cleaning operation was carried out while confirming that the pH of the waste water pit 7 would not become lower than 7.0, and the cleaning operation was terminated when no change was observed in the pH at the neutral region of the cleaning liquid.

A cleaning liquid was prepared by dissolving 3,000 kg of sodium hydrogencarbonate in 50 $m^3$ of water, and during the cleaning, 275 kg was dissolved in 4.3 $m^3$ of water and added, and finally, 3,275 kg of sodium hydrogencarbonate and 54.3 $m^3$ of industrial water were used. The pH of the cleaning liquid was pH 8.03 at the initiation of the operation and pH 7.85 upon expiration of 90 minutes.

Washing with water was carried out for one hour by industrial water at a rate of 50 $m^3$/hr by a spray nozzle. The pH was 7.85 at the initiation of washing with water and 7.33 upon expiration of 150 minutes.

In this Example, in the cleaning operation, the duration of the operation was 2.5 hours, and the amount of industrial water used was 104 $m^3$.

As a result of the inspection after completion of the cleaning operation, the acidic deposit was completely removed, and no corrosion of the elements was observed.

EXAMPLE 4

Comparative Example

The same elements as in Example 3 were subjected to water jet cleaning with industrial water.

The cleaning operation was such that the operation time was 11 hours, and the amount of industrial water used was about 600 $m^3$.

As a result of the inspection after completion of the washing operation, the acidic deposit remained on the elements, and corrosion of the elements was observed.

EXAMPLE 5

Comparative Example

In the same manner as in Example 3 except that as the cleaning liquid, industrial water was used instead of using the 6% sodium hydrogencarbonate aqueous solution, cleaning with water was carried out by a spray nozzle until the pH of the cleaning water became at least 6.0. The cleaning with water was carried out for 12 hours by using industrial water at a rate of 50 $m^3$/hr.

As a result of the inspection after completion of the cleaning operation, the acidic deposit remained on the elements, and corrosion of the elements was observed.

EXAMPLE 6

Example of the Present Invention

Elements of an air heater installed on a combustion furnace of a power plant were detached and cleaned with a 5% sodium hydrogencarbonate aqueous solution. This air heater was operated for about 2 months using a heavy oil containing 0.3% of a sulfur content as a fuel.

Further, the type of the air heater was a horizontal regenerative rotary heat exchanger (manufactured by ALSTOM Power K.K.), wherein the high temperature portion was made of a mild steel sheet (SS400), and the lower temperature portion was made of a corrosion resistant steel (CRLS, manufactured by NIPPON STEEL CORPORATION).

The acidic deposit attached to the air heater was sampled, and the components were analyzed. The results are shown in Table 2. The derivation of the respective components in Table 2 is the same as in Example 1.

TABLE 2

| Components | Content |
|---|---|
| Na | 1.8% |
| K | 0.01% |
| Ca | 0.2% |
| Mg | 1.3% |
| V | 0.2% |
| $NH_4^+$ | 0.001% |
| $SO_4^{2-}$ | 7.8% |
| pH (0.1% solution) | 3.42 |
| Water-insolubles | 70% |

In a storage tank, a 5% sodium hydrogencarbonate aqueous solution was prepared as a cleaning liquid, and the elements were immersed in the cleaning liquid. After immersing the elements for 3 hours while cleaning so that the pH of the cleaning liquid was maintained to be within a range of from 7.0 to 8.0, the elements were withdrawn from the cleaning liquid, and washing with water was carried out until the pH of the washing water became 7.8. Cleaning was carried out with respect to 264 elements having a size of 850×840×500 mm. The amount of sodium hydrogencarbonate used was 6,000 kg, and the amount of industrial water used was 400 $m^3$ in a total of the cleaning liquid and water used for washing with water.

As a result of the inspection after completion of the cleaning and washing operation, the acidic deposit was completely removed, and no corrosion of elements was observed.

EXAMPLE 7

Example of the Present Invention

The operation was carried out in the same manner as in Example 3 except that a sodium hydrogencarbonate slurry having a solid concentration of 2.9%, was used as a cleaning liquid instead of the 6% sodium hydrogencarbonate aqueous solution.

In a mixing vessel 6, 25 $m^3$ of industrial water was added to 3,275 kg of sodium hydrogencarbonate, and the slurry was sent to a waste water pit 7. In the waste water pit 7, agitating was continued by a stirrer so that the solid content would not precipitate. Cleaning was carried out for 90 minutes, and then washing with industrial water by a spray nozzle was carried out at a rate of 50 $m^3$/hr for 1 hour.

As a result of the inspection after completion of the cleaning and washing operation, the acidic deposit as completely removed, and no corrosion of the elements as observed.

In this Example, cleaning was carried out with a sodium hydrogencarbonate slurry, the amount of water used for the cleaning liquid was small as compared with Example 3.

EXAMPLE 8

Example of the Present Invention

The operation was carried out in the same manner as in Example 5 except that a 15% sodium carbonate aqueous solution was used as a cleaning liquid instead of using the 6% sodium hydrogencarbonate aqueous solution.

After immersing the elements for 3 hours while watching so that the pH of the cleaning liquid would be within a range of from 6.0 to 10.5, washing with water was carried out until the pH of the washing water became 7.8. The amount of sodium carbonate used was 3,800 kg, the amount of industrial water was 250 $m^3$ in a total of the cleaning liquid and water used for washing with water.

As a result of the inspection after completion of the cleaning and washing operation, the acidic deposit was completely removed, and no corrosion of the elements was observed.

EXAMPLE 9

Example of the Present Invention

Corrosiveness to iron was compared among a 5% sodium hydrogencarbonate aqueous solution, a 5% sodium hydrogensulfate aqueous solution, a 1% sulfuric acid aqueous solution and water. A zinc plating on the surface of an iron plate for tests (tradename: HULL CELL, manufactured by YAMAMOTO M. S. Co.) was removed with dilute sulfuric acid, then washed with water and acetone, dried and immersed in each of the above aqueous solutions for 72 hours. The difference in mass of each iron plate for test between before and after immersion in each of the above aqueous solutions, was measured and compared. The results of the comparison are shown in Table 3.

From Table 3, it is evident that sodium hydrogensulfate which is believed to be the main component of the acidic deposit, has a corrosive action, and sodium hydrogencarbonate has no corrosive action.

TABLE 3

| Solute | pH | Mass of test specimen (g) Before the test | After the test | Difference | Reduction ratio (%) |
|---|---|---|---|---|---|
| Sodium hydrogencarbonate | 8.4 | 10.4074 | 10.4064 | 0.0010 | 0.01 |
| Sodium hydrogensulfate | 1.7 | 10.4326 | 10.0413 | 0.3913 | 3.75 |
| Sulfuric acid | 1.8 | 10.5491 | 7.0492 | 3.4999 | 33.2 |
| Nil (only water) | 7.6 | 10.4165 | 10.4159 | 0.0006 | 0.01 |

According to the present invention, an acidic deposit which is formed by combustion of a fuel containing a sulfur content and which attaches to e.g. a heat exchanger in e.g. a boiler, a dust-collecting installation or an apparatus installed in a gas flow path such as a piping, can be removed efficiently, simply and safely in a short period of time without corrosion of the base material of the apparatus. Further, the amount of waste water can be reduced.

What is claimed is:

1. A method for removing an acidic deposit comprising a sulfur compound on a piping, a flue or a heat exchanger, said acidic deposit comprising said sulfur compound being produced by combusting a fuel comprising a sulfur component, comprising:

(a) reacting said acidic deposit comprising said sulfur compound with an aqueous solution of an alkali metal carbonate and/or an alkali metal hydrogen carbonate to produce carbon dioxide gas, which produces foaming; and (b) removing said acidic deposit comprising said sulfur compound from said piping, said flue or said heat exchanger by the reacting and foaming in (a).

2. The method for removing an acidic deposit according to claim 1, wherein the sulfur compound comprises a sulfate having at least one ion selected from the group consisting of ammonium, sodium, potassium, magnesium, calcium and vanadium.

3. The method for removing an acidic deposit according to claim 2, wherein the alkali metal hydrogencarbonate is sodium hydrogencarbonate.

4. The method for removing an acidic deposit according to claim 1, wherein the acidic deposit is dipped in the aqueous solution of an alkali metal carbonate and/or an alkali metal hydrogencarbonate or sprayed with the aqueous solution, and then washed with water.

5. The method for removing an acidic deposit according to claim 1, wherein the heat exchanger comprises a regenerative rotary heat exchanger.

6. The method for removing an acidic deposit according to claim 3, wherein the concentration of an aqueous solution of the sodium hydrogencarbonate is from 3 to 16 mass %.

7. The method for removing an acidic deposit according to claim 3, wherein an aqueous solution of the sodium hydrogencarbonate comprises sodium hydrogencarbonate in a concentration of from 0.1 to 30 mass %.

8. The method for removing an acidic deposit according to claim 3, wherein the acidic deposit is dipped in an aqueous solution of the sodium hydrogencarbonate or sprayed with an aqueous solution of the sodium hydrogencarbonate, and then washed with water.

9. The method for removing an acidic deposit according to claim 3, wherein the sulfur compound comprises a sulfate having at least one ion selected from the group consisting of ammonium, sodium, potassium, magnesium, calcium and vanadium.

* * * * *